United States Patent [19]

Kushida et al.

[11] Patent Number: 4,637,553

[45] Date of Patent: Jan. 20, 1987

[54] FUEL INJECTION NOZZLE UNIT FOR INTERNAL COMBUSTION ENGINES

[75] Inventors: Takeo Kushida; Keiichi Yamada, both of Higashimatsuyama, Japan

[73] Assignee: Diesel Kiki Co., Ltd., Tokyo, Japan

[21] Appl. No.: 782,871

[22] Filed: Oct. 2, 1985

[30] Foreign Application Priority Data

Oct. 9, 1984 [JP] Japan ..... 59-210496

[51] Int. Cl.[4] ..... F02M 57/00

[52] U.S. Cl. ..... 239/533.4

[58] Field of Search ..... 239/102, 533.4, 533.5, 239/585

[56] References Cited

U.S. PATENT DOCUMENTS 3,830,433 8/1974 Miyake et al. ..... 239/585 X 3,836,080 9/1974 Butterfield et al. ..... 239/533.4 X 4,474,326 10/1984 Takahashi ..... 239/102

FOREIGN PATENT DOCUMENTS 57172167 4/1956 Japan .

*Primary Examiner*—Andres Kashnikow

*Attorney, Agent, or Firm*—Frishauf, Holtz, Goodman & Woodward

[57] ABSTRACT

In a fuel injection nozzle unit, a piezo-electric element is provided about a central plunger for controlling the lift of the nozzle needle to selectively inhibit and allow lifting of the central plunger by having its inner diameter decreased or increased in response to electrical energization or deenergization thereof, thereby adjusting the fuel injection rate characteristic.

2 Claims, 6 Drawing Figures

FUEL INJECTION NOZZLE UNIT FOR INTERNAL COMBUSTION ENGINES

BACKGROUND OF THE INVENTION

This invention relates to a fuel injection nozzle unit for internal combustion engines such as diesel engines, and more particularly to a fuel injection nozzle unit capable of controlling the lift of the nozzle needle.

It is generally required to vary the injection rate through an injection nozzle in order to maintain proper combustion conditions of an internal combustion engine over various operating regions of same, and the most effective way of varying the injection rate is to control the lift of the nozzle needle. A fuel injection nozzle unit adopting this concept of controlling the lift of the nozzle needle is already known, e.g., from Japanese Provisional Utility Model Publication (Kokai) No. 57-172167.

However, the conventional fuel injection nozzle unit is difficult to fabricate and too large in axial size, since it is constructed such that the lift of the nozzle needle is controlled by rotating a lift adjusting screw to change the axial position of a stopper for the nozzle needle.

SUMMARY OF THE INVENTION

It is the object of the invention to provide a fuel injection nozzle unit for internal combustion engines which is simply and compactly constructed but is capable of precisely controlling the lift of the nozzle needle.

The present invention provides a fuel injection nozzle unit for an internal combustion engine, including a nozzle body having injection holes and a pressure chamber formed therein, a nozzle needle fitted in the nozzle body for lifting to open the injection holes, a nozzle spring urging the nozzle needle in a direction of closing the injection holes, and a central plunger having one end thereof arranged opposite one end of the nozzle needle at a distance corresponding to a predetermined lift, and liftable together with the nozzle needle when the predetermined lift is exceeded, wherein the nozzle needle is lifted by a fuel pressure supplied to the pressure chamber to effect fuel injection. The fuel injection nozzle unit according to the invention is characterized in that it comprises a piezo-electric element provided around the central plunger, and means for selectively electrically energizing and deenergizing the piezo-electric element, the piezo-electric element being radially deformable in response to energization or deenergization thereof to allow or inhibit lifting of the central plunger.

The above and other objects, features and advantages of the invention will be more apparent from the ensuing detailed description taken in conjunction with the accompanying drawings.

DETAILED DESCRIPTION

The invention will now be described in detail with reference to the drawings showing embodiments thereof.

Figure 1:
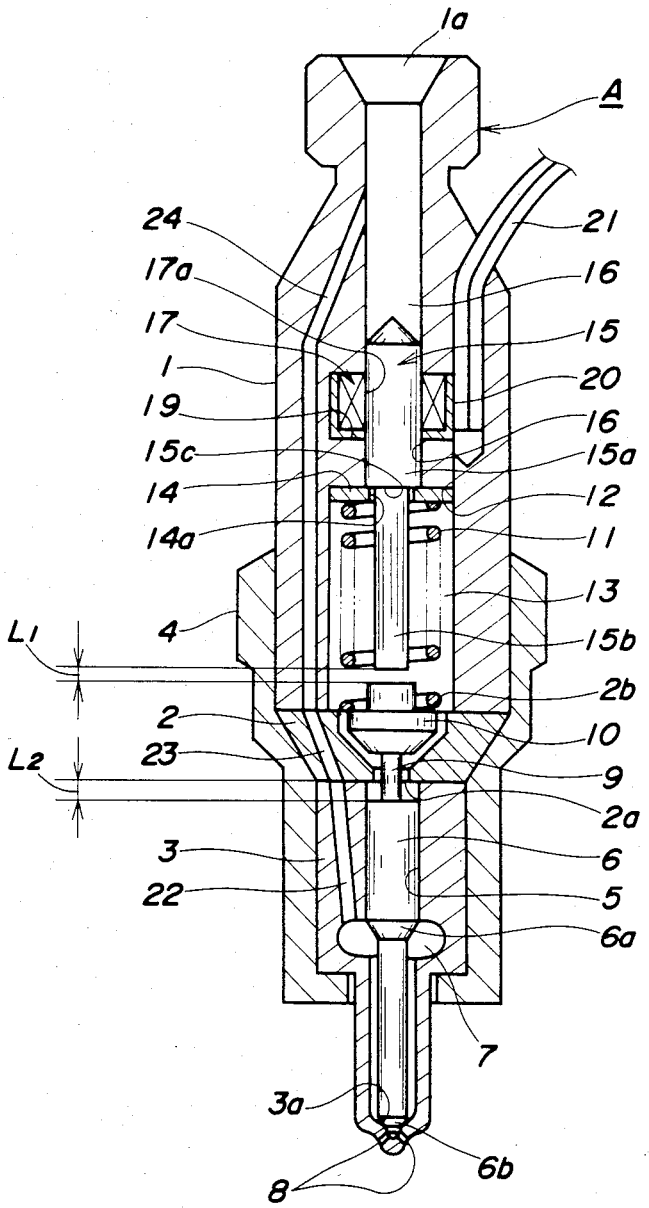
FIG. 1 is a longitudinal sectional view of a fuel injection nozzle unit according to a first embodiment of the invention.
Figure 2:
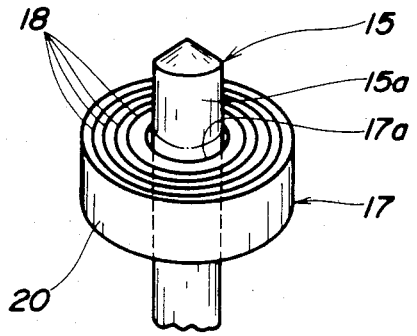
FIG. 2 is an enlarged perspective view of the piezo-electric element of FIG. 1.
Figure 3:
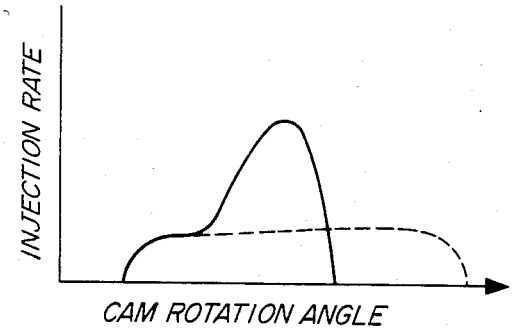
FIG. 3 is a graph showing curves for the fuel rate characteristics of the fuel injection unit according to the invention.

Referring first to FIGS. 1–3, a first embodiment of the invention will be explained. FIG. 1 shows a fuel injection nozzle unit A for internal combustions engines according to the invention, wherein reference numeral 1 designates a nozzle holder, by which is supported a nozzle body 3 by means of a retaining nut 4 threadedly fitted on the nozzle holder 1, with a distance piece 2 interposed between the nozzle holder 1 and the nozzle body 3. A nozzle needle 6 is axially slidably fitted in an axial bore 5 formed in the nozzle body 3. The nozzle needle 6 has a pressure stage **6*a* at an intermediate portion thereof, from which extend an upper half having a larger diameter and a lower half having a smaller diameter. The pressure stage 6*a* is normally located within a pressure chamber 7 formed in the nozzle body 3. A seating face 6*b* formed at the lower end of the nozzle needle 6 is normally seated on a seating face 3*a* formed at the lower end of the nozzle body 3, to close and open injection holes 8 formed in the lower end of the nozzle body 3 as the nozzle needle 6 is reciprocatingly moved. To be specific, the nozzle needle 6 is liftable in response to an increase in the pressure of fuel in the pressure chamber 7 to open the injection holes, and seatable on the seating face 3*a* to close them when it is in its lowest position, as shown in FIG. 1**.

Secured on top of the nozzle needle 6 is a head pin 9 which extends loosely through a small central hole **2*a* formed in the bottom of the distance piece 2 and is provided at its upper end with a movable spring seat 10 arranged in a recess 2*b* formed in the distance piece 2**.

A nozzle spring 11 is accommodated within a spring chamber 13 defined within the nozzle holder 1, with its lower end supported by the movable spring seat 10 and its upper end supported by a stationary spring seat 14 attached to a stepped shoulder 12 defining an upper end wall of the spring chamber 13, thus urging the nozzle needle 6 downward, i.e., in a direction of closing the injection holes via the movable spring seat 10.

A central plunger 15, which is a lift control member, is axially slidably provided in the nozzle holder 1. The central plunger 15 has an upper half **15*a* having a larger diameter and a lower one 15*b* having a smaller diameter, with an intermediate stepped shoulder 15*c* formed at the border therebetween. The thicker portion 15*a* is fitted in an axial bore 16 axially extending upward from the stepped shoulder 12, with a diameter smaller than that of the spring chamber 13, while the thinner portion 15*b* of the central plunger 15 axially extends downward through a central hole 14*a* of the stationary spring seat 14 into the spring chamber 13 of the nozzle holder 1. The lowest position that the central plunger 15 can assume is determined by the stationary spring seat 14 whose upper surface abuts with the stepped shoulder 15*c* of the central plunger 15**.

When the central plunger 15 is in its lowest position, its lower end face and the upper end face of the movable spring seat 10 face each other with a gap L1 for initial injection lift therebetween, while the upper end face of the nozzle needle 6 and the opposed lower end face of the distance piece 2 define therebetween a gap L2 for total lift.

Figure 6:
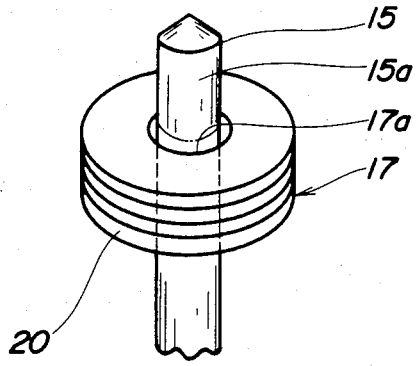
FIG. 6 is an enlarged perspective view of another example of piezo-electric element employed in a unit according the invention.

Provided around the thicker portion 15*a* of the central plunger 15 is a piezo-electric element 17, which, as shown in FIG. 2, is in the form of an annulus and disposed to radially contract when electricity is applied to electrodes 18 provided on one end face of the annulus. The piezo-electric element 17 has a multi-layered structure having a plurality of annular layers fitted one over another. Alternatively, it may be formed of a single layered structure. Furthermore, although in FIG. 2 the layers are radially superimposed one upon another, the same effect may also be obtained if the layers are axially superimposed, as shown in FIG. 6. The piezo-electric element 17 is fitted in an annular groove 19 formed in the inner peripheral wall of the axial bore 16 in the nozzle holder 1, and the thicker portion 15*a* of the central plunger 15 penetrates a central through hole 17*a* formed in the piezo-electric element 17. The diameter of the central through hole 17*a* of the central plunger 17*a* is set at such a value as to be slightly greater than the outer diameter of the thicker portion 15*a* of the central plunger 15 when electricity is applied to the electrodes 18. On the other hand, when energized through the application of electricity to the electrodes 18, the piezo-electric element 17 radially contracts to reduce the diameter of the central hole 17*a* whereby the inner peripheral wall of the annulus squeezes the thicker portion 15*a* of the central plunger 15 to prevent the central plunger 15 from lifting. When the piezo-electric element 17 is deenergized, the annulus expands to its original size to restore the original diameter of the central hole 17*a* to thereby allow the central plunger 15 to lift. The lower end face and the outer peripheral surface of the piezo-electric element 17 are covered with a soft protective sheet 20. The electrodes 18 of the piezo-electric element 17 are electrically connected via conductor wires 21 to an electronic control unit (not shown), which is supplied with signals indicative of various engine operation parameters required for controlling the fuel injection, such as engine rotational speed, engine load, engine coolant temperature, and exhaust gas temperature, from respective engine operation parameter sensors, not shown, and outputs a control signal, which is determined on the basis of these input signals, for selectively energizing or deenergizing the piezo-electric element 17 to obtain injection rates optimal to operating conditions of the engine.

The axial bore 16 in the nozzle holder 1 communicates with a fuel inlet 1*a* provided in top of the nozzle holder 1 and continuous with the axial bore 16. The fuel inlet 1*a* is connected to a fuel injection pump via an injection pipe, neither of which is shown, so that the central plunger 15 receives at its upper end face the pressure of fuel supplied from the fuel injection pump. Also, the pressure chamber 7 is in communication with the axial bore 16 via passages 22, 23, and 24 formed, respectively, in the nozzle body 3, the distance piece 2, and the nozzle holder 1, the passage 24 opening into the axial bore 16 at a location above or upstream of the top of the central plunger 15, as seen in FIG. 1.

The fuel injection nozzle unit of the invention constructed as above operates as follows:

Pressurized fuel delivered from the fuel injection pump enters the axial bore 16 through the fuel inlet 1*a* to be delivered into the pressure chamber 7 through the passages 24, 23, and 22 in this order. The incoming fuel flow causes an increase in the fuel pressure within the pressure chamber 7, which in turn acts upon the pressure stage 6*a* (having a sectional area As) of the nozzle needle 6. When the fuel pressure P1 within the pressure chamber 7 rises to overcome the urging force F1 of the nozzle spring 11 (P1 F1/As), that is, when it reaches an initial valve opening pressure, the nozzle needle 6 is lifted through the gap L1 for initial injection lift against the urging force of the nozzle spring 11, whereupon the seating face 6*b* of the nozzle needle 6 leaves the seating face 3*a* of the nozzle body 3, to thereby effect a low rate injection through the injection holes 8. Then, let it be assumed that the piezo-electric element 17 is deenergized by ECU. If the engine is in a high speed region, the fuel pressure within the pressure chamber 7 further increases so that the relationship P F/(An−Ac) is established, where F is the force of the nozzle spring 11 after being compressed by the gap L1, Ac is the cross-sectional area of the upper thicker portion of the central plunger 15, P is the fuel pressure, and An is the cross-sectional area of the upper thicker portion of the nozzle needle 6, that is, the fuel pressure reaches a main valve opening pressure, whereupon the nozzle needle 6 is lifted together with the central plunger 15 through the gap L2−L1 for main injection lift against the force of the nozzle spring 11 and the pressure force of the pressurized fuel in the axial bore 16 to thereby effect a high rate injection through the injection holes 8.

On the other hand, if the piezo-electric element 17 is energized, it radially contracts to thereby keep the central plunger 15 from being lifted from its lowest position as shown in FIG. 1, even after the above low rate injection is effected. Thus, even when the pressure within the pressure chamber 7 is increased above the initial valve opening pressure, the nozzle needle 6 is kept in its initial lift position, so that only the low rate injection is continued. As noted above, with the piezo-electric element 17 deenergized, the injection characteristic will be such as is shown by the solid curve in FIG. 3, which is obtained by a conventional fuel injection nozzle unit of this kind equipped with a central plunger, whereas with the piezo-electric element 17 energized, the injection characteristic will be such as shown by the broken curve in FIG. 3, wherein the low rate injection is continued as long as the piezo-electric element 17 is energized.

Although in the above described embodiment the method of the invention is applied to a fuel injection nozzle unit of a type wherein the injector is connected to a fuel injection pump by way of an injection pipe, the method is also applicable to a unit injector wherein a plunger for pumping out pressurized fuel, which forms part of a fuel injection pump, and a fuel injection nozzle are combined in one body and mounted in the cylinder head.

Figure 4:
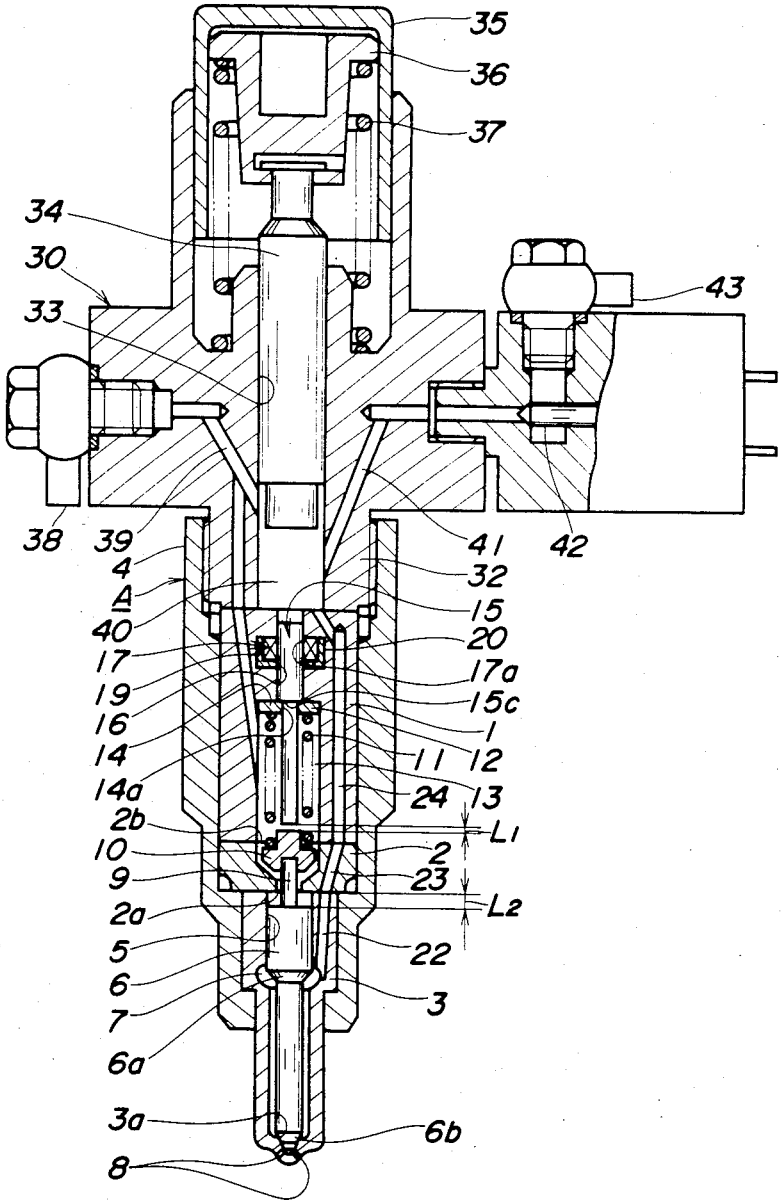
FIG. 4 is a transverse cross-sectional view of a fuel injection nozzle unit according to a second embodiment of the invention.

FIG. 4 illustrates a unit injector of such a type that the injection beginning and the injection end are determined by opening and closing a solenoid valve, and to which the method of the invention is applied. In FIG. 4, corresponding elements and parts to those in FIG. 1 are designated by identical reference characters. In the figure, reference numeral 30 designates a main body of the unit injector, incorporating a plunger barrel 32 by which is supported at its lower end an injection nozzle unit A according to the invention. A pumping plunger 34 is slidably fitted in an axial through bore 33 of the plunger barrel 32. As a rotating cam, not shown, in slidable contact with a cover 35 is rotatively driven by an internal combustion engine, not shown, the cover 35 is reciprocatingly moved together with a spring seat 36 serving as a tappet, the plunger 32 held by the spring seat 36 is forced to make reciprocating movement through the axial bore 33, with the aid of a plunger spring 37, sucking fuel into a plunger chamber 40 through a fuel inlet 38 and a fuel supply port 39 during its lifting stroke, and pressurizing, during its descending stroke, the fuel within the chamber 40 after blocking the fuel supply port 39 with its outer peripheral surface, when a drain or overflow port 41 is closed by a solenoid valve 42 to thereby force the fuel into a pressure chamber 7 through passages 24, 23, and 22 in this order. When the fuel pressure within the pressure chamber 7 reaches an initial valve opening pressure, the nozzle needle 6 is lifted through the gap L1 for initial injection lift to thereby open nozzle holes 8 to effect a low rate injection through the injection holes 8, similarly as in the embodiment of FIG. 1. Then, if the piezo-electric element 17 is deenergized, as the fuel pressure in the pressure chamber 7 rises to reach a main injection valve opening pressure, the nozzle needle 6 is lifted through the gap L2−L1 for main injection lift to thereby cause a high rate fuel injection through the injection holes 8, like the embodiment of FIG. 1. On the other hand, if on this occasion the piezo-electric element 17 is energized, the low rate fuel injection continues.

Now, if the drain port 41 is opened by opening the solenoid valve 42, the pressurized fuel within the plunger chamber 40 escapes through the drain port 41 and an outlet 43 into a fuel tank, not shown, whereby the pressure within the plunger chamber 40 and hence the pressure within the pressure chamber 7 suddenly drop to allow the nozzle spring 11 to return the nozzle needle 6 into its valve closing position, hence the injection terminates.

Figure 5:
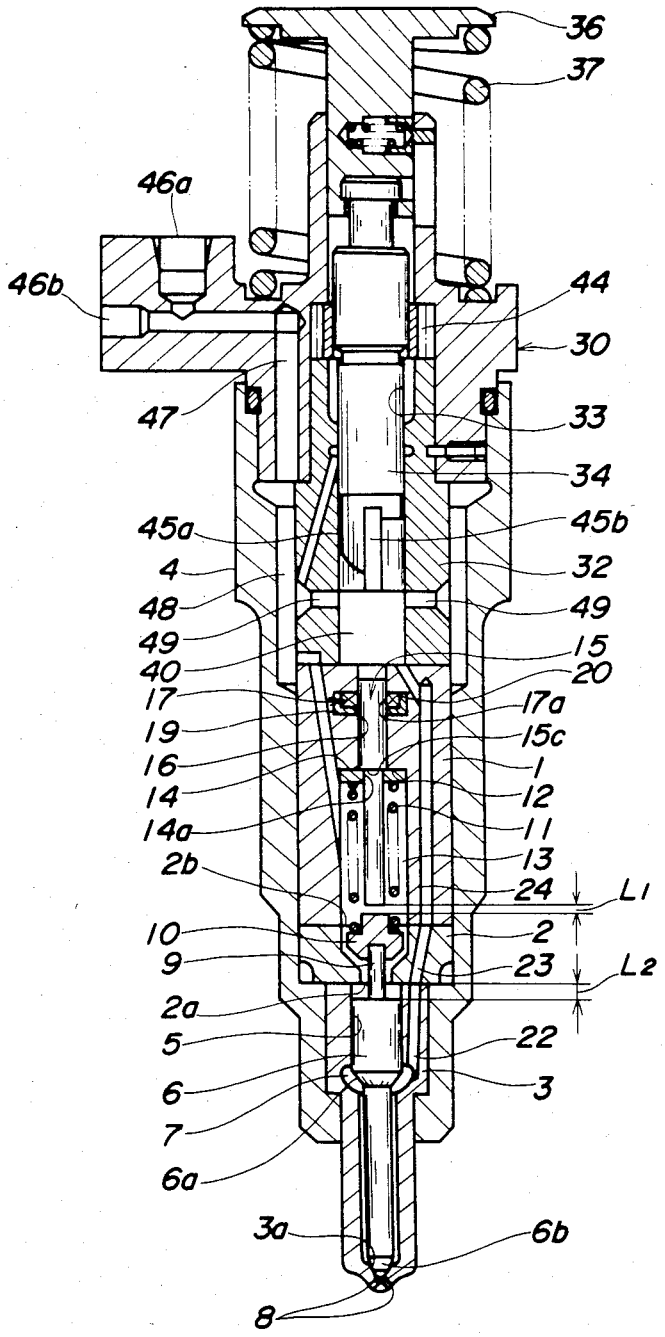
FIG. 5 is a longitudinal sectional view of a fuel injection nozzle unit according to a third embodiment of the invention.

As stated above, although according to the embodiment of FIG. 4, the pumping plunger 34 only reciprocates without rotating, and the injection beginning and the injection end are controlled by opening and closing the solenoid valve 42, the application of the method of the invention is not limited to this type, but the method of the invention may be applied to such a type as shown in FIG. 5, wherein the pumping plunger 34 is disposed to rotate as well as reciprocate, and a control rack connected to a governor (neither of which is shown) causes the plunger 34 to rotate so as to change the time the fuel is allowed to overflow during the descending stroke of the plunger 34, whereby the fuel delivery quantity is controlled. According to the embodiment of FIG. 5, the pumping plunger 34 is provided with a pinion 44 which meshes with a control rack, not shown, to be driven thereby to change the circumferential position of the former with respect to the main body 30, hence operation of the control rack causes a rotation of the pumping plunger 34, to thereby control the effective delivery stroke thereof, i.e., the fuel delivery quantity. Incidentally, in FIG. 5, reference numerals **45*a* and 45*b* designate, respectively, a plunger helix and a vertical groove formed in the outer peripheral wall of the pumping plunger 34, and 46*a* and 46*b* designate, respectively, a fuel outlet and a fuel inlet provided in the unit injector body 30, which are in communication with the plunger chamber 40 by way of a port 47 formed in the main body 30, an annular suction gallery 48 defined between the outer peripheral surface of the plunger barrel 32 and the inner wall of the retaining nut 4, and an intake port 49 formed in the plunger barrel 32. During the lifting stroke of the pumping plunger 34, fuel is drawn through the suction gallery 48 and the intake port 49 into the plunger chamber 40, and during its descending stroke, after the intake port 49 is blocked by the outer peripheral surface of the plunger 34, the fuel drawn into the plunger chamber 40 is pressurized, and when its pressure reaches the valve opening pressure, fuel is injected in the same manner as in the embodiment of FIG. 4. When the intake port 49 is put in communication again with the plunger chamber 40 by way of the vertical groove 45*b* the pressure within the plunger chamber 40 suddenly drops whereby the nozzle needle 6** closes the valve to terminate the injection.

Since the other elements and parts in FIG. 5 are identical in construction and function with corresponding parts of the embodiments of FIG. 1 and FIG. 4, they are designated by identical reference characters, and description thereof is omitted.

What is claimed is:

1. In a fuel injection nozzle unit for an internal combustion engine, including a nozzle body having injection holes and a pressure chamber formed therein, a nozzle needle fitted in said nozzle body and being liftable in said nozzle body to open said injection holes, a nozzle spring urging said nozzle needle in a direction of closing said injection holes, and a central plunger having one end thereof arranged opposite one end of said nozzle needle at a distance corresponding to a predetermined lift, said central plunger having another end face which is supplied with pressurized fuel, and said central plunger being liftable together with said nozzle needle against the pressure of said pressurized fuel when said predetermined lift is exceeded, said nozzle needle being lifted by a fuel pressure supplied to said pressure chamber to effect fuel injection, the improvement comprising:

an annular-shaped, radially deformable piezo-electric element provided around said cental plunger, said piezo-electric element having a substantially central hole therein which is penetrated by said cental plunger; and means for selectively electrically energizing and deenergizing said piezo-electric element to selectively radially deform said piezo-electric element to thereby selectively reduce the diameter of said central hole thereof, said central hole of said piezo-electric element being sufficiently reduced in diameter to contact the peripheral surface of said central plunger to inhibit lifting of said central plunger from a predetermined position closest to said nozzle needle when said piezo-electric element is electrically energized to thereby maintain a low rate injection, and said central hole of said piezo-electric element having a normal increased diameter so as to allow movement of said central plunger in said central hole to thereby allow lifting of said central plunger from said predetermined position when said piezo-electric element is electrically deenergized to thereby obtain a high rate injection.

2. A fuel injection nozzle unit as claimed in claim 1, wherein said piezo-electric element has a lower end face thereof and an outer peripheral surface thereof covered with a soft protective sheet.

* * * * *